United States Patent [19]

Rosier

[11] Patent Number: 4,796,455

[45] Date of Patent: Jan. 10, 1989

[54] COMPACT OFFSET NOSE ASSEMBLY FOR SETTING FASTENERS

[75] Inventor: Hendrik E. Rosier, Kingston, N.Y.

[73] Assignee: Huck Manufacturing Company, Irvine, Calif.

[21] Appl. No.: 29,935

[22] Filed: Mar. 24, 1987

[51] Int. Cl.[4] ..... B21D 31/00

[52] U.S. Cl. ..... 72/391; 72/453.17

[58] Field of Search ..... 72/391, 453.17, 114, 72/453.19; 29/243.53

[56] References Cited

U.S. PATENT DOCUMENTS

| | | | |
|---|---|---|---|
| 2,170,323 | 8/1939 | Gorshkoff | 72/391 |
| 3,157,305 | 11/1964 | Baugh | 72/391 |
| 3,605,478 | 9/1971 | Chirco | 72/391 |
| 3,665,581 | 5/1972 | Gulistan | 72/391 |
| 3,713,321 | 1/1973 | La Pointe | 72/391 |
| 3,774,437 | 11/1973 | Young | 72/391 |
| 4,368,631 | 1/1983 | Tanikawa | 72/391 |
| 4,615,206 | 10/1986 | Rosier | 72/391 |
| 4,649,732 | 3/1987 | Molina | 72/391 |

FOREIGN PATENT DOCUMENTS

| | | | |
|---|---|---|---|
| 40013 | 3/1980 | Japan | 72/391 |
| 100936 | 6/1983 | Japan | 72/391 |

*Primary Examiner*—David Jones
*Attorney, Agent, or Firm*—Lawrence J. Shurupoff; Robert F. Hess

[57] ABSTRACT

A nosepiece for setting lockbolt fasteners includes an anvil housing connected to a collet member via a roll pin. The roll pin securely anchors a drawbar within the collet to form an non-threaded connection therebetween. The drawbar is adapted to be connected to and rigidly supported within a piston of an installation tool. The rigidity of the piston and tool is transferred to the nosepiece by the drawbar so as to prevent nosepiece deflection during setting of the lockbolt.

5 Claims, 3 Drawing Sheets

PRIOR
ART
1
2
3
4
5
6
7
8
9
10
11
13
14
15
16
17
18
19
20
23
25
A
A1

PRIOR
ART
3
5
7
27
28

FIG 5
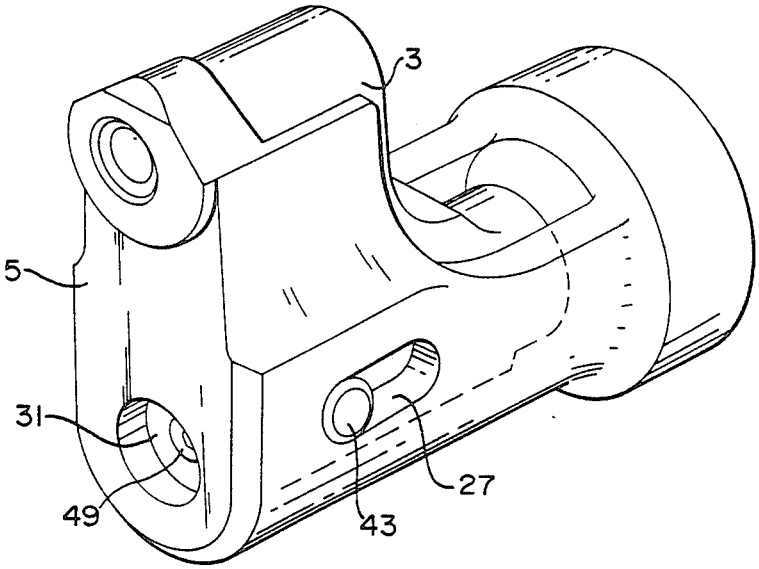
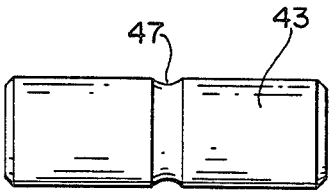
FIG 6

COMPACT OFFSET NOSE ASSEMBLY FOR SETTING FASTENERS

BACKGROUND OF THE INVENTION

1. Field of the Invention

This invention relates generally to tools for setting fasteners having pin members with pull grooves and more particularly concerns a compact nose assembly for lockbolt installation tools. The nose assembly is designed to minimize deflection between a collet and anvil during swaging of a collar about a pin member.

2. Description of Prior Developments

A demand has arisen for a rigid yet compact installation tool for setting fasteners of the lockbolt type. A tool is required which can access and install such fasteners which are located between closely spaced panels or within a small clearance space. To satisfy this demand, various attempts have been made to provide an offset nose assembly including an anvil and collect for swaging a fastener collar about a grooved fastener pin. In such designs, the swaging anvil is radially offset from the axis of the piston which drives the anvil against the collar. This arrangement allows the radially offset anvil portion of the nose assembly to access and set fasteners without interference from the anvil housing and/or from the body of the installation tool.

By offsetting the axis of the fastener pin and collar assembly from the axis of the tool piston, large bending forces are generated within the nose assembly during swaging of the collar around the pin. These bending forces have heretofore resulted in deflection between the anvil and collet as well as deflection of the entire nose assembly with respect to the body of the installation tool and with respect to the pin and collar. This deflection has typically resulted in the application of a radial force to the pin and has caused radial deflection of the pin during setting of the fastener. This radial deflection, when tranmitted and applied to the fastener pin, has caused premature and/or uncontrolled pin breakage resulting in defective connections between the pin and collar. This problem is particularly acute when titanium alloyed pins are used since these pins are most sensitive to radial loading and will easily shear under such radial loads before the collar is fully set.

To prevent this undesirable result, prior designs have attempted to resist the deflection of offset nose assemblies by increasing the size and mass of the anvil housing, the collet and the threaded collet stud which connects the collet to the tool. These massive and bulky assemblies thus attempted to provide the necessary rigidity within the nose assembly per se. While such designs have generally performed satisfactorily, they have not been able to access extremely close or cramped installation sites due to their relatively large and massive construction. That is, in order to stiffen the nose assembly, prior anvil housings and collets have been designed with thick cross sections thereby resulting in relatively bulky and wide contours incapable of reaching within small spaces.

Accordingly, a need exists for a compact offset nose assembly which resists deflection under load, prevents undesirable pin deflection, avoids premature and/or uncontrolled pin failure yet is more compact than prior designs so as to allow access of the nose assembly within tight or cramped spaces.

SUMMARY OF THE INVENTION

The present invention has been developed to solve the problems noted above and therefore has as a primary object the provision of a compact offset nose assembly which resists deflection during tool actuation yet which defines a relatively compact profile for accessing limited spaces.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein:

FIG. 5 is a perspective view of the nose assembly of FIGS. 3 and 4; and

FIG. 6 is a front elevation view of the rolling cross pin.

DETAILED DESCRIPTION OF THE PREFERRED EMBODIMENTS

Figure 1:
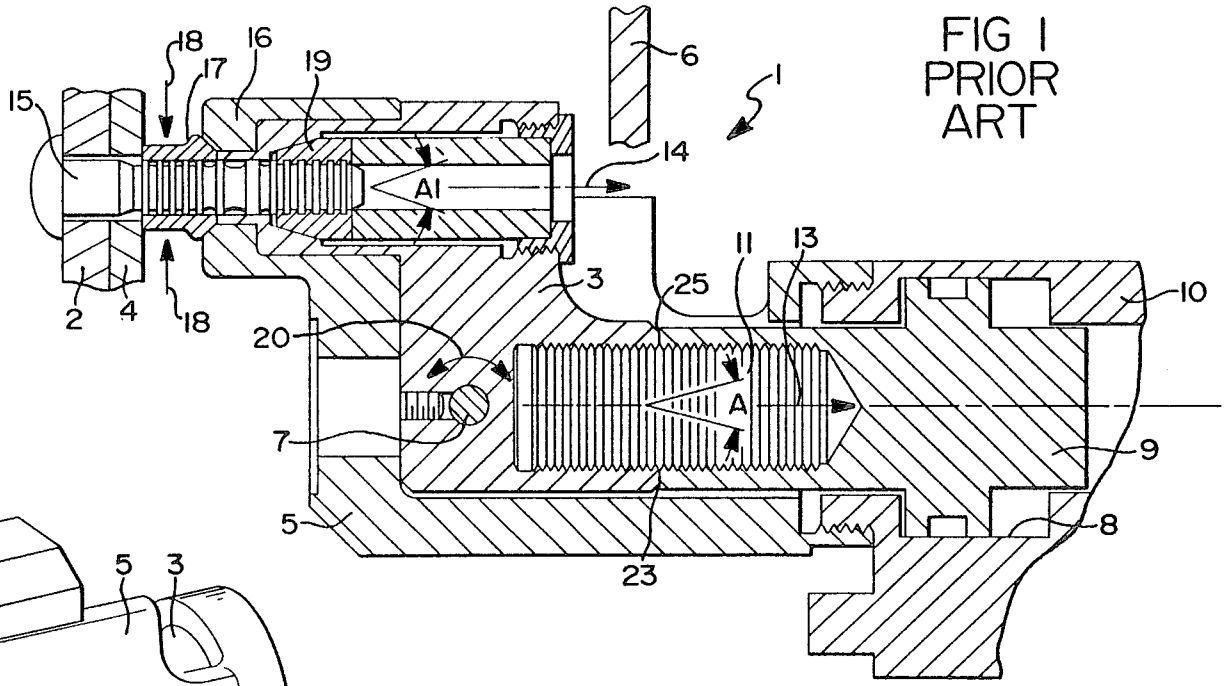
FIG. 1 is a longitudinal sectional view through a nose assembly according to the prior art.

In order to fully appreciate the advantages of the present invention, reference is initially made to a known offset nose assembly 1 shown in FIG. 1. Collet member 3 is slidably nested within anvil housing 5 and guided therein via pin 7 during tool actuation. The collet is connected to a hydraulically powered reciprocating piston actuator 9 via threaded stud 11. The piston is guided within a bore 8 formed within the body of installation tool 10 shown in fragment.

Upon actuation of piston 9, stud 11 axially pulls collet 3 in the direction of arrow 13. The collet, which grips and pulls pin 15 in the general direction indicated along pin axis 14, generates a reactionary force which causes the anvil 16 to abut collar 17 and swage the collar about the pin in a known fashion. In this manner a lockbolt connection is completed across panel members 2, 4. Because the anvil 16 is radially offset from the base portion of the anvil housing, the nose assembly may reach within the small clearance space defined between abutting panel members 2 and 4 and panel member 6.

Since large forces are developed during swaging, any assembly tolerances within the offset nose located between the piston and anvil will allow the collet 3 and jaws 19 to rock or cant within the anvil housing such as indicated by directional arrows 20. This rocking or canting during swaging will result in the application of a radial load to the pin as represented by arrows 18. As noted above, any radial force applied to the pin is generally undesirable. Preferably, a pure axial pull along the axis of the pin is desired.

As further seen in FIG. 1, a primary cause of deflection between the collet and anvil housing is the threaded fit between the stud 11 and piston 9 and between the stud 11 and collet 3. Prior assemblies such as shown in FIG. 1 have specified a class two fit between the grooves and threads along these connections. Such a fit allowed the stud to wobble or shift about the axis of the piston over an angle A. This shifting in turn caused the collet to be pulled or shifted over angle A such that the axis of the jaws 19, which is preferably collinear with the axis of the pin, would be shifted over a corresponding angle of deflection A1. This resulted in the application of a radial load to the pin and promoted premature and/or uncontrolled pin failure.

Another problem associated with this conventional threaded interconnection is the fracture of the threaded stud at the respective interfaces 23, 25 between the stud and piston and the stud and collet. As the stress at these points is concentrated due to the deflection and loading of the threads noted above, fracture and failure of the stud at these points is not uncommon.

Figure 2:
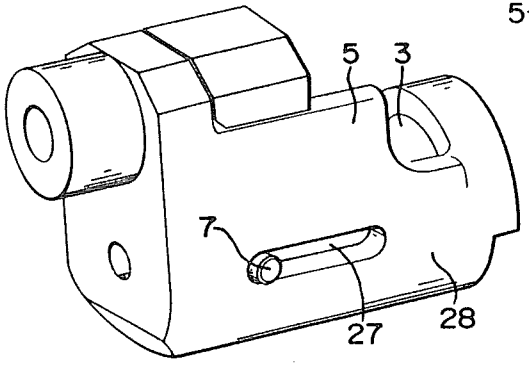
FIG. 2 is a perspective view of the nose assembly of Figure 1.

As seen in FIG. 2, the collet of FIG. 1, is slidably guided within the anvil housing via pin 7 and slots 27 formed through opposing walls 28 of the anvil housing. Pin 7 is typically frictionally retained within the collet with an interference fit such that the pin slides along the linear surfaces of the slots to guide the movement of the collet during tool actuation. Because of the high forces encountered between the pin and slot surfaces during swaging, the pin is subject to rapid wear. As the pin wears, an additional source of slop or deflection develops within the nose assembly to exacerbate the uncontrolled pin failure problem referred to above.

Figure 3:
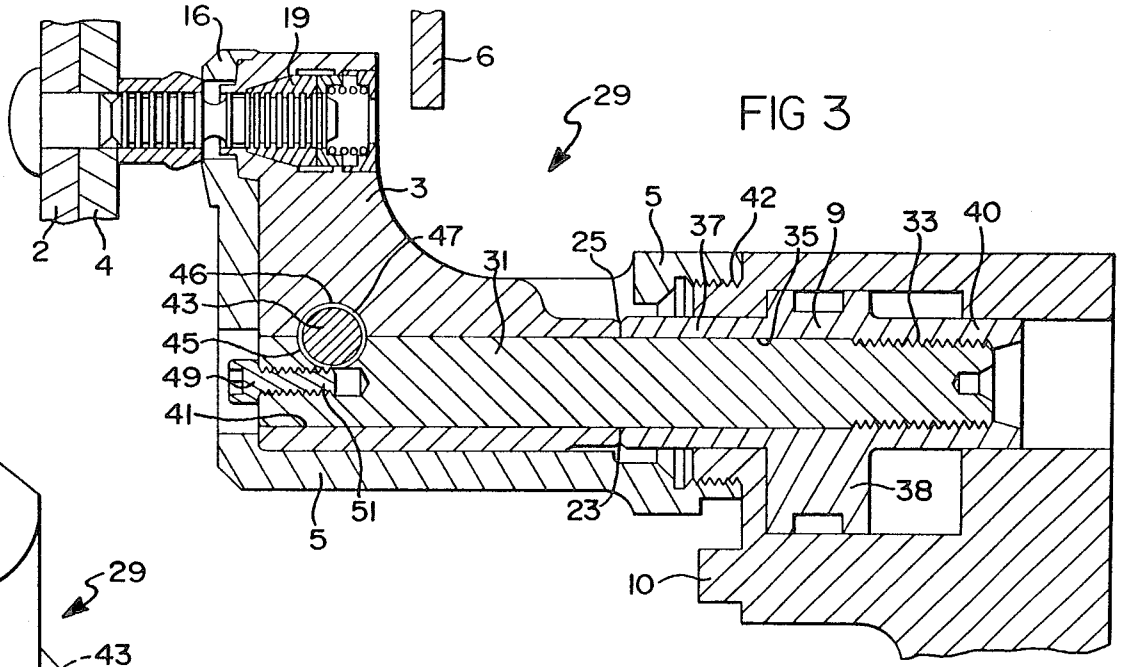
FIG. 3 is a longitudinal sectional view through the nose assembly according to the present invention.
Figure 4:
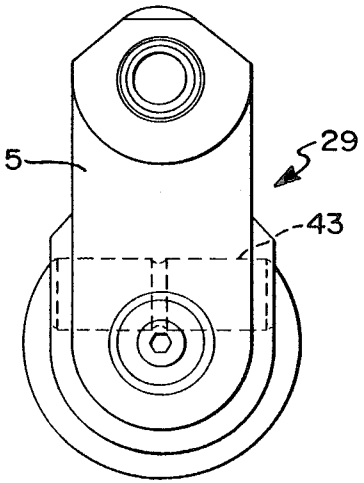
FIG. 4 is a front elevation view of the nose assembly of FIG. 2.

To minimize the deflection between the anvil and collet and between the collet and piston, and to minimize the application of radial loads to the pin, the compact nose assembly 29 shown in FIGS. 3, 4 and 5 has been developed according to the present invention. A critical feature of this nose assembly is the interconnection between the collet and piston via drawbar 31. Although the drawbar is axially connected to the piston 9 via threaded drawbar portion 33, no substantial radial support is provided to the drawbar by this threaded fit. Moreover, the mating threads do not determine or control the fit between these elements.

Rather, radial support of the drawbar is provided by a close non-threaded fit between a smooth-walled axial bore 35 formed within a tubular extension 37 of piston 9 and through substantially the entire axial extent of the solid body portion 38 of the piston. Drawbar 31 is formed with a smooth, accurately-machined axially extending surface to smoothly and slidably fit within bore 35 with a total radial clearance of about .001 inch. The drawbar preferably extends completely through the piston and into a rearwardly extending tubular threaded section 40 to take full advantage of the piston'-ssupport and rigidity. The longitudinal axis of the drawbar is radially offset from the central axis of the anvil and the jaws. While a cylindrical drawbar is shown, any smooth and continuous axially extending surface configuration may be used.

Several advantages are achieved by this interconnection which may not be immediately appreciated. First, failure of the drawbar at the interfaces 23, 25 is avoided since the drawbar is substantially uniformly supported throughout axial bore 35. This extensive support surface substantially reduces stress concentration at interface 23, particularly in the absence of a threaded connection at this juncture. Moreover, by eliminating any threaded interconnection between the drawbar and collet at junction 25, stresses are correspondingly reduced at this interface, as further discussed below.

By supporting and closely radially confining the drawbar within the piston and within its tubular extensions, the overall rigidity of the nose assembly may be significantly increased without resorting to massive support sections within the collet and anvil. This rigidity provided by the continuous and intimate Hertzian contact between the piston and drawbar allows the design of a relatively narrow nose assembly which is highly resistant to deflection. The radial support and structural rigidity of the nose assembly is provided not by strengthening the collet and anvil but rather by using the rigidity provided by the piston 9 and tool body 10.

That is, since the piston and tool are designed to accommodate extremely high hydraulic pressures required to set the collar and pin, the piston and the tool body 10 surrounding the piston are by necessity of extremely rigid construction. That is, the piston is mounted within the tool body with an extremely close fit required to contain high hydraulic pressures. Not only is the piston body 38 closely supported within the tool, but the tubular piston extensions 37, 40 are likewise supported in the tool body. As seen in FIG. 3, the massive cross section of the tool body provides tremendous support and rigidity to the piston, which in turn provides support and rigidity to the drawbar through the tight fit therebetween.

By securely anchoring drawbar 31 within the piston in the manner shown, and by limiting assembly tolerances therebetween to no more than 0.001 inch, the rigidity of the tool body 10 may be effectively transferred to the collet 3 to provide the support necessary to prevent excessive nose deflection. This eliminates the necessity of forming the collet and anvil whith thick and bulky cross sections. Not only does this allow the nose assembly access to tighter areas, but it also allows a reduction in weight of the entire nose assembly.

As further seen in FIG. 3, the drawbar is snugly fitted within smooth walled longitudinal or axial bore 41 formed through collet 3. The axis of bore 41 is radially offset from the axis of the anvil 16. As with the fit between the drawbar and piston, the fit between the drawbar and collet is preferably maintained within a total clearance of approximately 0.001 inch. This tight radial fit will prevent any meaningful or adverse radial deflection between the collet and drawbar. The clearance between the pin and slot is also similarly controlled to about 0.001 inch. The rigidity of the connection of the drawbar to the piston and of the piston to the tool frame is thus provided to support the collet and resist its deflection during swaging. The rigidity of the tool body is transferred to the anvil via threaded interconnection 42.

The drawbar is connected and fixed to the collet and the collet is accurately guided within the anvil housing with roll pin 43 shown in FIG. 6. A transverse recess 45, preferably of semicircular cross section, is formed across the drawbar to closely complement the outer diameter of the roll pin. An extremely tight tolerance is preferably maintained between these surfaces when assembled, on the order of approximately 0.0001 inch. A similar close fit of the same approximate tolerance is formed between the roll pin and a cylindrical bore 46 formed transversely through the collet.

The roll pin is thus closely but freely fitted within the collet to allow free rolling movement within the collet and along the surfaces of slot 27 formed within the anvil housing walls. With this arrangement, the piston transmits power and movement to the collet via the roll pin and drawbar. This pinned interconnection is not only stronger than a threaded connection, it is also less susceptible to wear.

To prevent the roll pin from sliding out of the collet, a circumferential groove 47 is formed in the roll pin and an axially disposed retainer such as hex screw 49 is anchored within the drawbar. The screw is disposed to allow a small radial clearance between the retainer screw shank 51 and the surface of the groove 47 thereby allowing the roll pin to roll within the collet yet preventing the roll pin from moving transversely along its axis. In this manner, the collet is securely anchored to the drawbar. By allowing the roll pin to roll along the slot in the anvil housing, wear between these surfaces is minimized by the rolling contact. In addition, frictional forces between these surfaces are reduced since rolling friction is significantly less than sliding friction.

Obviously, numerous modifications and variations of the present invention are possible in light of the above teachings. It is therefore to be understood that within the scope of the appended claims, the invention may be practiced otherwise than as specifically described herein.

What is claimed is:

1. An offset nose assembly for swaging a lockbolt type collar about a lockbolt type fastener pin, comprising:

an anvil housing provided with a swaging anvil for swaging said collar around said pin, said swaging anvil having a central axis aligned with said pin during swaging;

a collet member mounted for axial movement within said anvil housing, said collet member adapted for receiving jaw means for gripping said pin, said collet member formed with an axially-extending smooth-walled bore having an axis radially offset from the central axis of said anvil;

a drawbar for connecting said collet member to an actuator of an installation tool, said drawbar having a substantially smooth axially-extending surface portion closely fitted within said axially-extending smooth-walled bore of said collet member for minimizing assembly tolerances therebetween; and a pin member rotatably mounted to said collet member, said drawbar securely connected and fixed to said collet member by said pin member for axially moving said collet member within said anvil housing so as to prevent excessive deflection of said nose assembly with respect to said pin during said swaging.

2. The assembly of claim 1, wherein said pin member is formed with an annular circumferential groove and wherein said drawbar further comprises retainer means extending through a portion of said groove so as to axially retain said pin member within said collet member.

3. An offset nose assembly for swaging a lockbolt type collar about a lockbolt type fastener pin, comprising:

an anvil housing provided with a swaging anvil for swaging said collar over said pin, said swaging anvil having a central axis aligned with said pin during swaging;

a collet member mounted within said anvil housing and adapted for axial movement during said swaging;

rolling means freely rotatably associated with said collet member for guiding said axial movement of said collet member within said anvil housing and for preventing deflection of said nose assembly during said swaging; and a drawbar having a longitudinal axis radially offset from the central axis of said swaging anvil, said drawbar being connected to said collet member for axially moving said collet member within said anvil housing to effect said swaging and said rolling means fixedly connecting said drawbar to said collet member.

4. The assembly of claim 3, wherein said rolling means comprises a freely rotating pin member interconnecting said collet member and said anvil housing.

5. The assembly of claim 4 wherein said pin member is formed with an annular circumferential groove and wherein said drawbar further comprises retainer means extending through a portion of said groove so as to axially retain said pin member within said collet member.

* * * * *